US009721715B2

(12) United States Patent
Roskos et al.

(10) Patent No.: US 9,721,715 B2
(45) Date of Patent: Aug. 1, 2017

(54) SOLID STATE COMPONENTS HAVING AN AIR CORE

(75) Inventors: Henry Roskos, Los Gatos, CA (US); Fredrick Quincy Johnson, Pleasanton, CA (US)

(73) Assignee: 2Sentient Inc., Las Vegas, NV (US)

( * ) Notice: Subject to any disclaimer, the term of this patent is extended or adjusted under 35 U.S.C. 154(b) by 0 days.

(21) Appl. No.: 12/357,948

(22) Filed: Jan. 22, 2009

(65) Prior Publication Data

US 2010/0182118 A1 Jul. 22, 2010

(51) Int. Cl.

| | |
|---|---|
| ***H01F 5/00*** | (2006.01) |
| ***H01F 27/28*** | (2006.01) |
| ***H01F 17/02*** | (2006.01) |
| *H01F 27/32* | (2006.01) |

(52) U.S. Cl.
CPC ..... *H01F 17/02* (2013.01); *H01F 27/323* (2013.01)

(58) Field of Classification Search
CPC ..... H01F 17/02
USPC ..... 336/200, 222, 223
See application file for complete search history.

(56) References Cited

U.S. PATENT DOCUMENTS

| | | | | |
|---|---|---|---|---|
| 5,425,167 | A * | 6/1995 | Shiga et al. | 29/606 |
| 5,576,680 | A * | 11/1996 | Ling | 336/200 |
| 5,793,272 | A | 8/1998 | Burgharts | |
| 5,884,990 | A * | 3/1999 | Burghartz et al. | 336/200 |
| 6,240,622 | B1 | 6/2001 | Ahn et al. | |
| 6,249,039 | B1 | 6/2001 | Harvey | |
| 6,292,086 | B1 | 9/2001 | Chu | |
| 6,357,107 | B2 | 3/2002 | Ahn | |
| 6,429,764 | B1 * | 8/2002 | Karam et al. | 336/200 |
| 6,531,945 | B1 | 3/2003 | Ahn | |
| 6,803,848 | B2 * | 10/2004 | Yeo et al. | 336/200 |
| 8,212,155 | B1 * | 7/2012 | Wright et al. | 174/263 |
| 2007/0020969 | A1 * | 1/2007 | Yungers | 439/77 |
| 2008/0143468 | A1 * | 6/2008 | Yokoyama et al. | 336/200 |
| 2010/0277115 | A1 * | 11/2010 | Lai | 320/101 |
| 2013/0143381 | A1 * | 6/2013 | Kikukawa | 438/381 |

* cited by examiner

*Primary Examiner* — Mangtin Lian
*Assistant Examiner* — Ronald Hinson
(74) *Attorney, Agent, or Firm* — Fish & Tsang., LLP

(57) ABSTRACT

Solid state components having an air core and methods of producing such components are presented. An air core component preferably has lower conducting bands, upper conducting, and conducting posts that collectively form a conducting coil. A coating material placed at least over the upper bands of the coil provides structural support for the coil. The coil can be built around or in a sacrificial core material that can be removed leaving an air core behind.

17 Claims, 7 Drawing Sheets

Top View

Front View

Top View

Front View

Top View

Front View

Top View

Front View

SOLID STATE COMPONENTS HAVING AN AIR CORE

RELATED APPLICATIONS

This application relates to U.S. patent application having Ser. No. 09/965,297 filed on Sep. 28, 2001, now abandoned. This and all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

FIELD OF THE INVENTION

The field of the invention is solid state component technologies.

BACKGROUND

There is a strong desire for developing high-Q inductors at ever smaller sizes using existing integrated circuit (IC) manufacturing techniques. However, current state of the art techniques require modification to IC processing technologies that are impractical for one reason or another. For example, the industry has a long felt need for creating air core inductors or transformers on a substrate where the inductors are robust during fabrication. Unfortunately, air core conducting coils have been extremely difficult to produce due to their flimsy nature, rendering them impractical for production.

Typically inductors have been produced having solid cores. However, such techniques are not always amenable to producing air core inductors. For example, U.S. Pat. No. 6,249,039 to Harvey et al describes techniques for producing inductive components having a solid core. However, manufacturing such a component is difficult because the process requires placement of shaped conducting bands around the solid core.

U.S. Pat. No. 5,425,167 to Shiga et al offers similar techniques to Harvey that can be used to form inductive components having an air core. Unfortunately, Shiga also suffers from the same limitation as Harvey by requiring shaped conducting bands. Utilizing shaped bands require modification of IC manufacturing processes which can be a costly endeavor. Furthermore, an inductor or transformer produced by the Shiga techniques lack sufficient structural integrity. Such device can not be mass produced in a reliable, repeatable fashion because the bands can bend or deformed during or after manufacturing causing changes to the device's desirable electrical properties (e.g. high-Q value, reduce parasitic capacitance, or reduced mutual inductance).

U.S. Pat. No. 6,531,945 to Ahn et al offers different techniques to produce solid core inductors without requiring shaped bands. Ahn's approach allows the use of existing, known IC processes for building solid core inductors. However, the approach is unsuitable for air core inductors. Should one wish to employ Ahn's technique for an air core inductor, then one would have to remove the solid substrate core leaving behind a flimsy rectangular coil lacking structure integrity.

U.S. Pat. No. 6,429,764 to Karam et al offers a solution for creating an air core inductor. The Karam approach includes providing a sacrificial core material that supports arched conducting bands. Once the arched bands are formed, the core material can be removed leaving behind an air core conducting coil. Unfortunately, producing the described arches in a repeatable, reliable manner proves to be quite problematic using existing techniques.

Ideally, one should be able to produce inductive components having an air core using simple existing IC process techniques. What has yet to be appreciated is that a conducting coil having an air core can be produce easily using existing techniques while maintaining structural integrity of the conducting coil.

Thus, there is still a need for components having an air core conducting coil where the coil is supported.

SUMMARY OF THE INVENTION

The present invention provides apparatus, systems and methods in which a solid state component having an air core is manufactured on a substrate and that is structurally supported.

One aspect of the inventive subject matter includes a component comprising a conducting coil having an air core. The conducting coil includes lower conducting bands, upper conducting bands, and a plurality of conducting posts that connect the upper and lower bands to form the conducting coil. Preferably, the coil is structurally supported by a coating material that is at least placed over the upper conducting bands. Contemplated coating materials include a curable substance or a material forming a passivation layer.

Alternative aspects of the inventive subject matter include methods of producing a solid state component having an air core. Lower conducting bands of the component can be placed on a substrate, possibly separated from the substrate by insulator material. A sacrificial core material can be placed on the lower conducting bands. The sacrificial core material can be employed as supporting material during the production process. Conducting posts can be positioned to be in electrical contact with the lower conducting bands. In some embodiments, the posts are created within the sacrificial core material through electroplating. Upper conducting bands can then be placed in electrical contact with the posts in a manner where the lower bands, upper bands, and posts form a conducting coil within or around the sacrificial core material. The sacrificial core material can then be removed, leaving behind a conducting coil having an air core. A coating material can be placed on the upper conducting bands, before or after removal of the core material, to provide hardened structural support for the coil to prevent deformation.

As used herein "inductor" means any component having a coil. Components having coils include inductors, transformers, or other device where conducting coils are useful. One skilled in the art should appreciate that the disclosed techniques can also be applied to transformers.

Various objects, features, aspects and advantages of the inventive subject matter will become more apparent from the following detailed description of preferred embodiments, along with the accompanying drawings in which like numerals represent like components.

DETAILED DESCRIPTION

Suitable techniques for manufacturing inductive components are described in co-owned U.S. patent application having Ser. No. 09/965,297, also incorporated by reference in its entirety.

Figure 1:
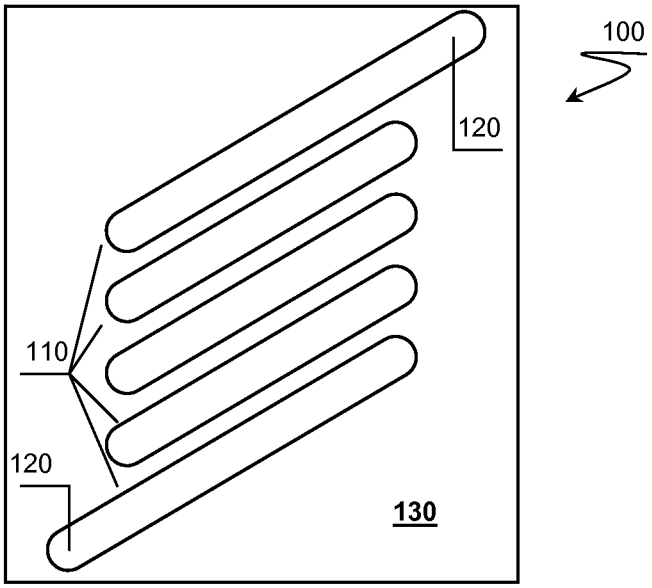
FIG. 1 is a schematic of a top view and front view an inductive component during an initial a stage of manufacturing where lower conducting bands are placed on a substrate.
Figure 1:
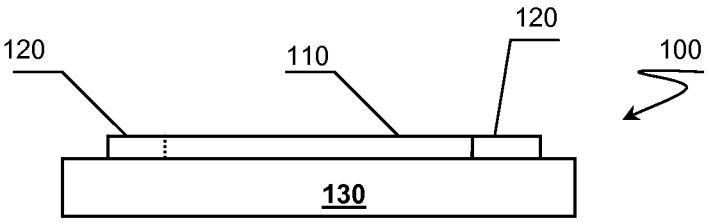

In FIG. 1, a top view and front view of inductor 100 is presented showing an initial stage of manufacturing. A plurality of lower conducting bands 110 are placed on substrate 130. Preferably, at least two of the lower bands providing inductor contacts 120.

Substrate 130 preferably comprises a semiconductor. Acceptable semiconductors include silicon (Si), doped silicon, gallium arsenide (GaAs), or other semiconductors commonly used in manufacture of ICs.

It is contemplated that an insulator layer (not show) can also be present between the lower conducting bands and substrate as is commonly used in micro component manufacturing processes. Typically, insulators include oxides, nitrides, spin on glass (SOG), or other insulators. An insulating layer can be grown or deposited using known methods.

Lower conducting bands 110 comprise a conducting material, preferably copper (Cu). Cu is a preferred conductor to reduce parasitic resistance. However, other conductors can also be used to manufacture inductor 100 including aluminum (Al), gold (Au), or other conductors.

Lower conducting bands 110 can be formed by creating a metal adhesion layer on the substrate then laying down a conducting seed layer from which lower bands 110 are formed. Photoresist can be used to mask areas where conductor is not desired. Once the photo mask is in place, the conductor can be plated into the regions forming bands 110. Any suitable technique can be used to form bands 110, including a Dual Damascene processes. After bands 110 are formed, the photoresist, seed layer, and adhesion layers can be removed leaving bands 110 on substrate 130.

It should be understood that lower bands 110 are not required to be directly on substrate 130, but can be placed on intervening layers. In this sense the phrase "on a substrate" also includes the concept of placing lower bands 110 directly on intervening layers that are in contact with substrate 130.

Preferably at least two of the lower bands 110 are extended beyond the main inductor region to form inductor contacts 120. Inductor contacts 120 serve as the contacts to other components within an IC system. It should be appreciated that contacts 120 can be sized and dimensioned as necessary to fulfill the needs of inductor 100.

Lower conducting bands 110 are sized and dimensioned according the requirements of inductor 100. Preferably lower bands 110 have a thickness in the range of 0.5 μm to 5 μm, with a preferred thickness of about 2 μm. Additionally, lower bands 110 preferably have a width in the range of 2 μm to 15 μm with a preferred width of about 10 μm. All ranges listed in this document are inclusive of their endpoints unless context dictates otherwise. The length of bands 110 can vary as desired to achieve necessary electrical properties for inductor 100 (e.g. Q-value, inductance, reduced parasitic resistance, or other electrical properties).

Lower bands 110 are preferably co-planar with respect to each other to simplify the manufacturing process.

Figure 2:
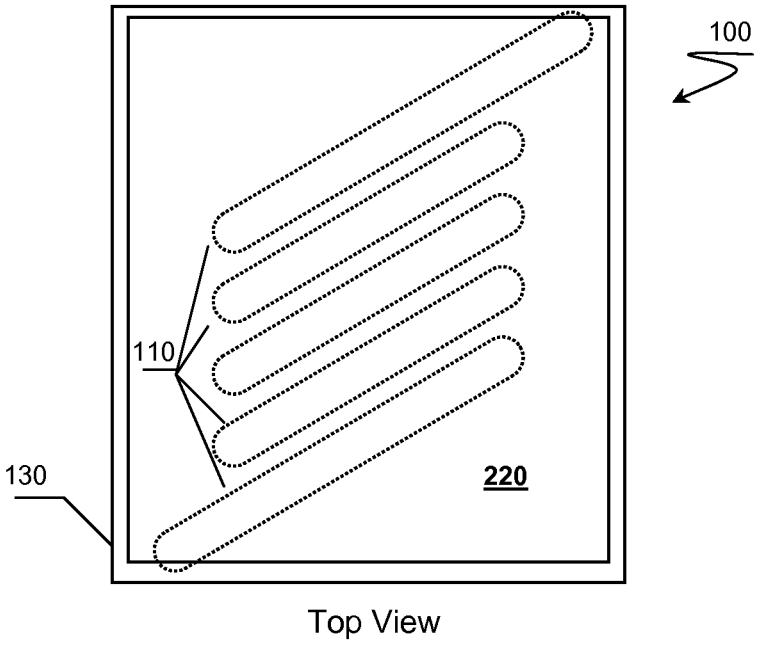
FIG. 2 is a schematic of a top view and front view the inductive component of FIG. 1 during a stage of manufacturing where a sacrificial core material is deposited on the lower conducting bands.
Figure 2:
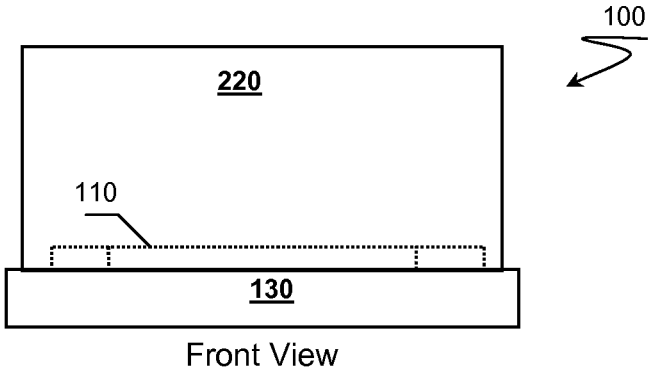

In FIG. 2, representing a subsequent stage of manufacture of inductor 100, sacrificial core material 220 is be placed on the lower conducting bands 110 and substrate 130. In a preferred embodiment, core material 220 comprises a non-magnetic substance. For example, an acceptable non-magnetic core material includes a photoresist deposited on lower conducting bands 110. However, it is also contemplated that core materials can also include metals, or even magnetic materials that can be etched away.

Core material 220 serves several purposes during the manufacture of inductor 100. One purpose includes forming a mask for vias that become conducting posts connecting upper conducting bands with lower conducting bands 110. Another purpose includes providing a surface on which upper conducting bands are formed.

Preferably, core material 220 substantially remains in placed (e.g. at least 80% remains) during the manufacturing process until the upper bands are completed. Eventually, core material 220 is at least partially removed to leave an air core behind.

Figure 3:
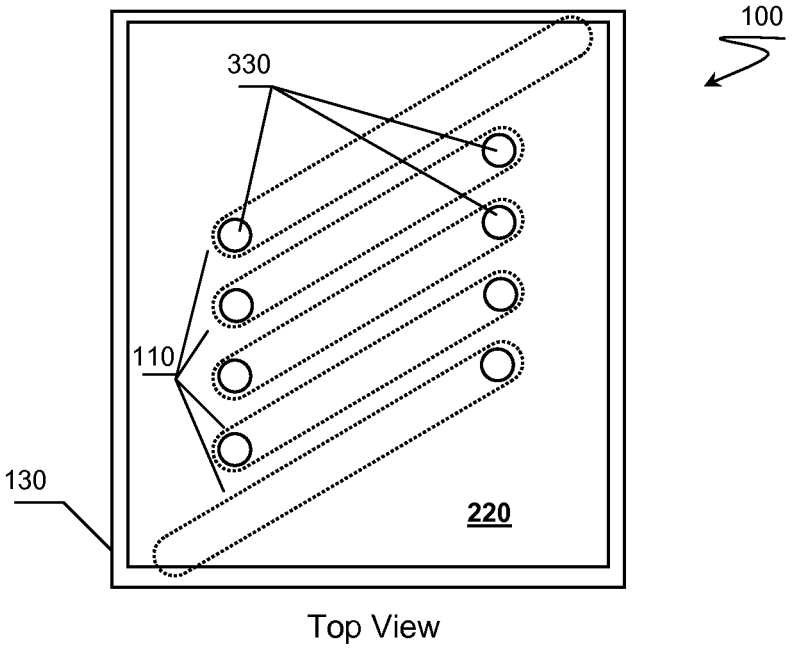
FIG. 3 is a schematic of a top view and front view the inductive component of FIG. 2 during a stage of manufacturing where conducting posts are provided.
Figure 3:
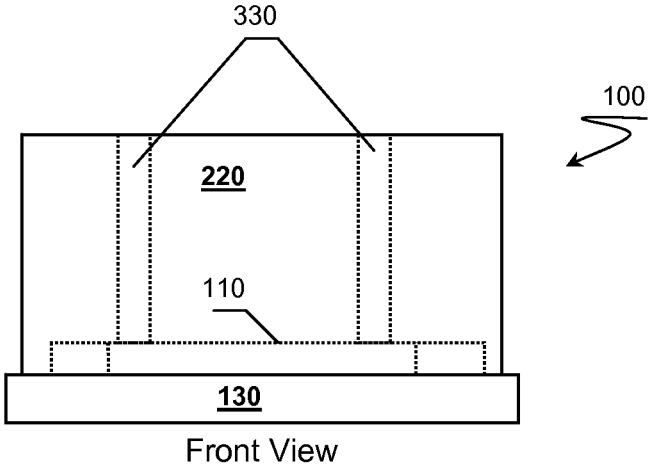

In FIG. 3, posts 330 are formed, possibly within the sacrificial core material 220, where the plurality of posts 330 electrically connect to lower bands 110. Posts 330 are provided to form the side walls of the conductive coil of inductor 100.

In a preferred embodiment, posts 330 comprise a conductor that is substantially similar to those used to form lower bands 110 or upper conducting bands. An especially preferred embodiment forms posts 330 by electroplating Cu within unmasked areas of sacrificial core material 220. However, any known technique for building posts 330 can be employed, including chemical deposition.

Posts 330 can be made any desirable height up to 10 μm to 50 μm to 100 μm or even greater heights. However, in a preferred embodiment, posts 330 are shorter than the length of lower bands 110 (or upper conducting bands) to facilitate structural integrity. Shorter posts reduce potential mutual inductance with neighboring components on the substrate by reducing the effective exposure area on the sides of the conductive coil of inductor 100.

Additionally in a preferred embodiment, minimizing peripheral common area between adjacent inductor bands (i.e., common inductor band sidewall area) and adjacent posts (i.e., common post sidewall area) thereby minimizing parasitic capacitance is achieved by fabricating the structure with width dimensions at least five times greater than the thickness of the adjacent inductor bands and posts.

Figure 4:
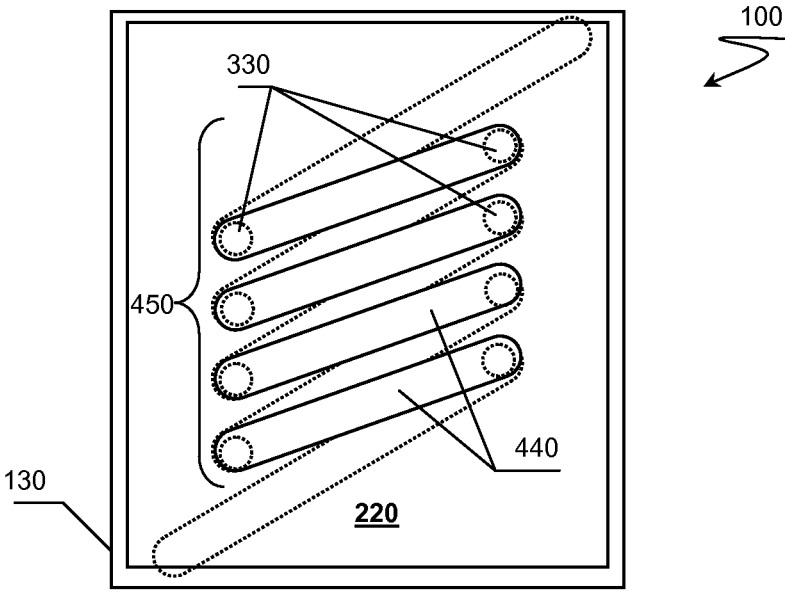
FIG. 4 is a schematic of a top view and front view the inductive component of FIG. 3 during a stage of manufacturing where upper conducting bands are provided.
Figure 4:
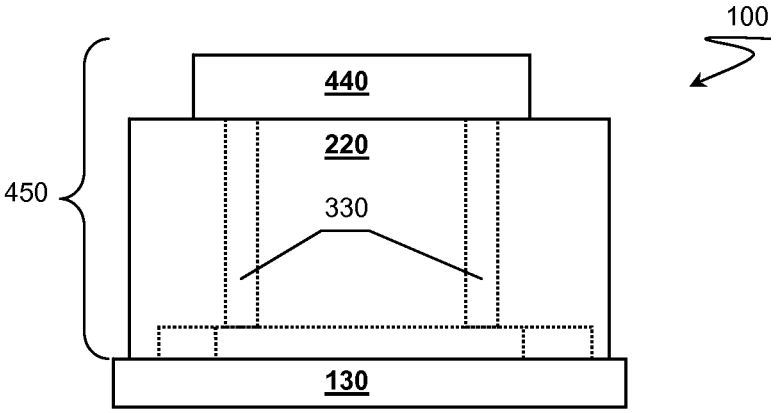

In FIG. 4, upper conducting bands 440 are placed on sacrificial core material 220 in a manner where they are electrically connected to posts 330. An upper band 440 connects to a post of one lower band while also connecting to a post of another lower band thereby forming conducting coil 450.

Preferably, upper bands 440 comprise the same conducting material as the lower bands and as posts 330, most preferably Cu. However, it is contemplated that upper bands 440 could comprise a different conductor than the lower bands. For example, a different conductor could be used to provide greater structural support.

Upper bands 440 can be formed using a similar process as employed to create the lower bands of coil 450. For example, the tops of posts 330 can be optionally etched slightly (e.g. less than 1000 Angstroms) to remove any surface oxidation to expose clean conductive surfaces. A seed layer of metal, preferably Cu, can then be deposited. Photoresist can then be used to mask areas where conductor is not desired. The conductor can then be plated in the unmasked area on core material 220 and that also electrically connects to posts 330. Alternatively, the seed metal layer may be omitted entirely and the conductor deposited through the open areas created during the photo-masking process.

Preferably, upper bands 440 comprise a thickness greater than the thickness of the lower bands, at least greater than 2 μm, to provide further structural integrity through the remaining stages of the manufacturing process.

Upper bands 440, similar to lower bands 110, are preferably co-planar with respect to each other to simplify the manufacturing process.

Conducting coil 450 preferably comprises a rectangular cross sectional area. By adjusting the width and height of the rectangular cross section, the electrical properties of inductor 100 can be configured. For example, inductance can be maximized while minimizing parasitic capacitance or overall resistance of the entire coil can be reduced.

Figure 5:
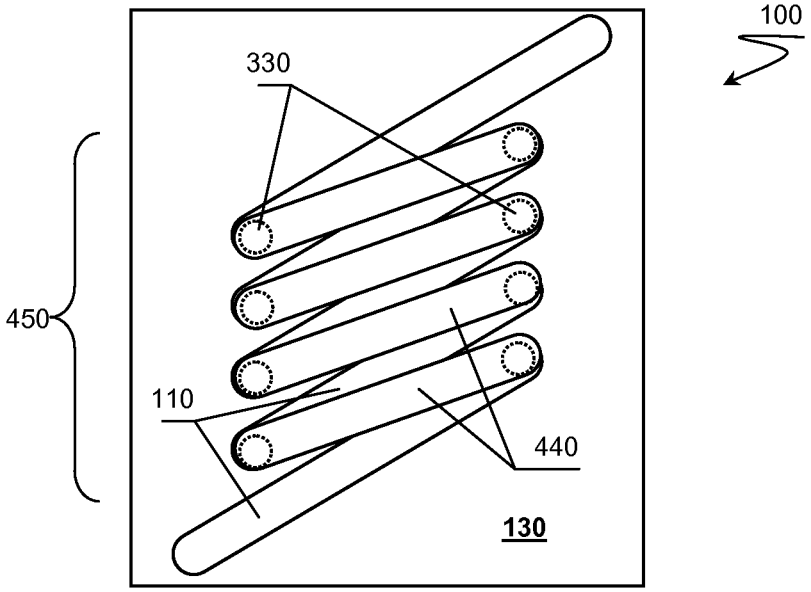
FIG. 5 is a schematic of a top view and front view the inductive component of FIG. 4 during a stage of manufacturing where the sacrificial core material is removed.
Figure 5:
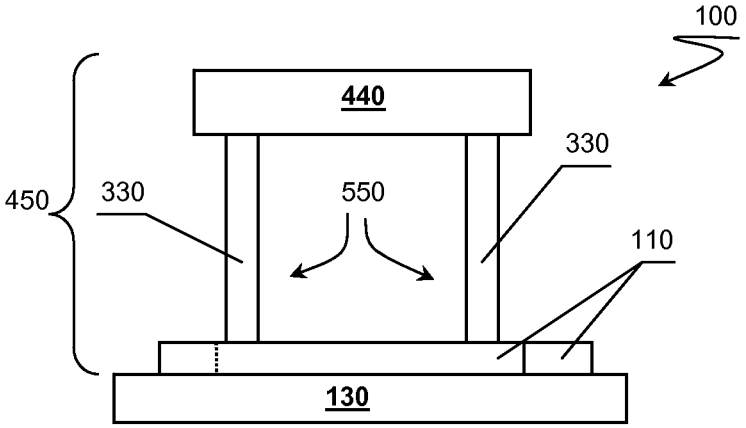

In FIG. 5, inductor 100 is exposed after sacrificial core material 220 has been removed leaving behind conducting coil 450 having an air core 550. Conducting coil 450 comprises lower conducting bands 110, conducing posts 330, and upper conducting bands 440. One should note that the number of loops in conducting coil 450 can be adjusted as desired.

Sacrificial core material 220 can be removed in a manner that is in accordance with the type of material used. In a preferred embodiment, where a photoresist is used as core material 220, the photoresist can be washed away using appropriate solvents known to anyone skilled in current integrated circuit processing techniques. It is also contemplated that core material 220 can be chemically etched away when a metallic substance is used as a core material 220.

Preferably, air core 550 provides sufficient isolation between opposing conducting surfaces to have a proper Q-value or inductance for inductor 100. In a preferred embodiment, air core 550 provides an isolation distance between adjacent inductor bands and posts from 2 μm to 7 μm with a preferred isolation of 5 μm.

Figure 6:
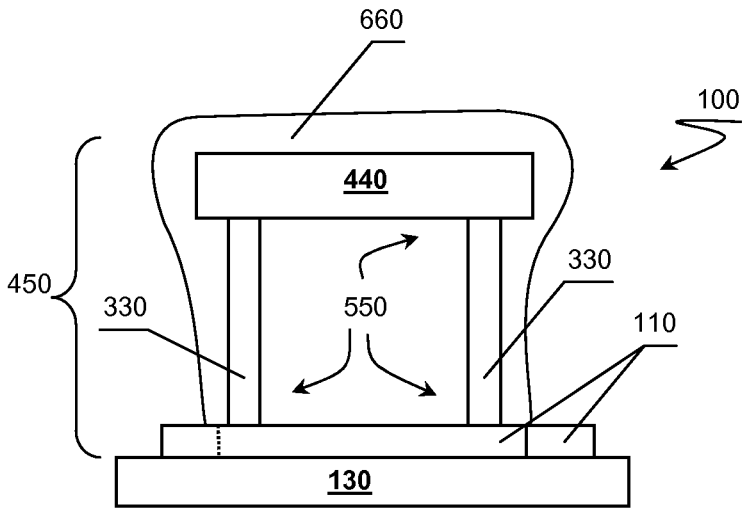
FIG. 6 is a schematic of a front view of the inductive component of FIG. 5 during a stage of manufacturing where a coating material is applied to the component.

In FIG. 6, coating material 660 is applied at least over a portion of the conducting coil to provide support for the coil. In the example shown in FIG. 6, coating material 660 is applied over upper conducting bands 440 leaving air core 550 substantially intact. It should be appreciated that coating material 660 can be applied at any time after upper bands 440 have been formed. For example, coating material 660 can be applied before core material 220 is removed. Alternatively coating material 660 can be applied after core material 220 is removed from inductor 100.

Coating material 660 preferably comprises a substance capable of providing hardened support for conducting coil 450. Preferred coating materials include curable substances or a passivation layer. Example curable substances can include polyimide, resins, or low temperature glassivation. Example passivation layers can include an epoxy or other material to prevent oxidation of the conductor used in coil 450.

In a preferred embodiment, coating material 660 is applied with sufficient thickness to provide structural support and to resist deformation of coil 450. Preferred thicknesses are at least a thick as upper conducting bands 440. It is contemplated that coating material 660 can have a thickness that is greater than 2 μm or even greater than 5 μm.

Coating material 660 does not necessarily completely coat coil 450. Rather, coating material 660 preferably covers at least a portion of coil 450 (e.g. upper bands 440 or posts 330) to hold coil 450 in place. For example, in a preferred embodiment, coating material 660 is applied before removing core material 220 and holds upper bands 440 in place. Such an approach allows for use of higher temperature coatings. Additionally, applying coating material 660 to form a partial seal over coil 450 allows access from the top or sides of coil 450 to remove at least some of sacrificial core material 220.

Figure 7:
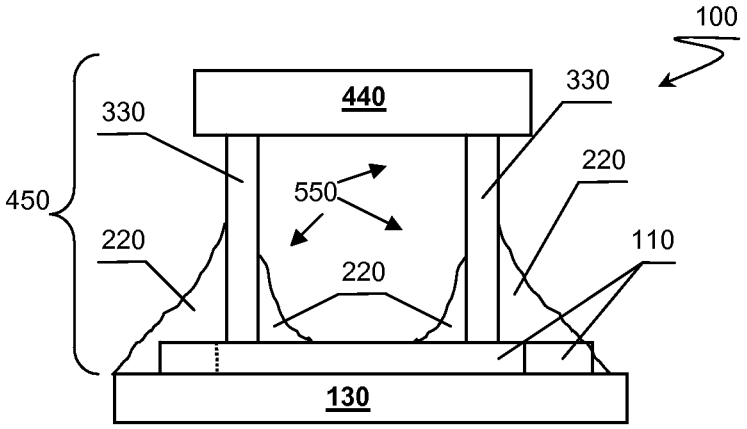
FIG. 7 is a schematic of a front view of the inductive component of FIG. 4 during a stage of manufacturing where a coating material comprises the sacrificial core material.

It is also contemplated that coating material 660 could comprise sacrificial core material 220 as shown in FIG. 7. In FIG. 7, sacrificial core material 220 has been removed leaving some core material around a portion of coil 450. In such an embodiment, core material 220 can be removed from the core region of coil 450 leaving air core 550 while retaining some material around posts 330, for example. Core material 220 then provides hardened support for coil 450 without requiring an additional step during manufacture to apply a coating layer. This approach reduces the inductance of the overall structure while also providing a physically strong device and simplifying production in an IC fab.

One should note that the physical dimensions of inductor 100 can be altered to meet the electrical requirements for the desired part. For example, a preferred inductor has a reduced mutual inductance and parasitic capacitance by configuring conducting coil 450 to have a width-to-height ratio greater than 2. Additionally, a preferred conducting coil 450 has conducting bands that have a width-to-thickness ratio greater than 5 to reduce parasitic capacitance.

Using the disclosed techniques, one can create inductors having high-Q values (e.g. greater than 20) preferably greater than 40 while simultaneously having desirable inductance and lower resistance. Preferred inductors produced by the disclosed approach have inductances in the preferred range from approximately 0.5 nano-Henrys (nH) up to approximately 100 nH which can be used for RF circuits.

Using the disclosed methods, inductive components can be manufactured in large quantities in a high quality, repeatable process. Existing, known techniques are used in the manufacturing process without requiring IC wafer fabrication facilities to alter their existing process or to take on risky, low yield procedures. The inductive components are also built in a manner where their conductive coils have hardened structural support to ensure robustness during and after manufacture. Additionally, many millions of such components can be placed on wafers along with other components without substantial interference.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A solid state component disposed on a substrate, the component having:

a plurality of electrically conducting lower bands above the substrate;

a plurality of electrically conducting upper bands;

a plurality of electrically conducting posts extending between the lower bands and the upper bands, forming a conducting coil having a region bounded by (a) the plurality of upper bands, (b) the plurality of lower bands and (c) the plurality of posts, which is at least partially filled with air to form an air core, and at least partially filled with a solid material that is disposed about at least part of the posts and on at least a first portion of a surface of each lower band that faces the air core, providing hardened support to the conducting coil, and wherein a second portion of a surface of each lower band facing the air core is exposed to the air core; and a coating material disposed around at least a portion of the upper bands that provides hardened support for the conducting coil while leaving the air core substantially intact within the coil.

2. The component of claim 1, wherein a first one of the plurality of lower conducting bands is approximately coplanar along its entire length between first and second ones of the posts.

3. The component of claim 1, wherein a first one of the plurality of upper conducting bands is approximately coplanar along its entire length between first and second ones of the posts.

4. The component of claim 1, wherein the coating material comprises a curable substance.

5. The component of claim 1, wherein the coating material comprises at least one of a passivation layer and a sacrificial core material.

6. The component of claim 1, wherein the plurality of electrically conducting lower bands and the plurality of electrically conducting upper bands comprise a common composition.

7. The component of claim 1, wherein the plurality of electrically conducting upper bands comprise copper.

8. The component of claim 7, wherein the conducting posts comprise copper.

9. The component of claim 1, wherein the conducting coil has a Q-value greater than 20 and an inductance in the range from 0.5 nH to 100 nH.

10. The component of claim 1, wherein the air core is substantially rectangular in vertical cross-section.

11. The component of claim 1, wherein the coating material is disposed around substantially all of the conducting coil.

12. The component of claim 1, wherein the coating material is disposed around an outer perimeter of the conducting coil.

13. The component of claim 1, wherein the coating material has a thickness of at least 2 μm.

14. The component of claim 1, wherein the coating material comprises an epoxy material.

15. The component of claim 13, wherein the coating material has a thickness of at least 5 μm.

16. The component of claim 1, wherein both the plurality of upper bands and the plurality of lower bands are disposed on a single side of the substrate.

17. The component of claim 1, wherein the solid material comprises a sacrificial core material.

* * * * *